US008911250B2

(12) United States Patent
Ehlen et al.

(10) Patent No.: US 8,911,250 B2
(45) Date of Patent: Dec. 16, 2014

(54) FLOATING BUS BAR CONNECTOR

(71) Applicants: Jon Brian Ehlen, Milpitas, CA (US); Pierluigi Sarti, Milpitas, CA (US)

(72) Inventors: Jon Brian Ehlen, Milpitas, CA (US); Pierluigi Sarti, Milpitas, CA (US)

(73) Assignee: Facebook, Inc., Menlo Park, CA (US)

( * ) Notice: Subject to any disclaimer, the term of this patent is extended or adjusted under 35 U.S.C. 154(b) by 253 days.

(21) Appl. No.: 13/645,908

(22) Filed: Oct. 5, 2012

(65) Prior Publication Data

US 2014/0099806 A1 Apr. 10, 2014

(51) Int. Cl.
*H01R 13/64* (2006.01)

(52) U.S. Cl.
USPC ..... 439/251; 439/248

(58) Field of Classification Search
USPC ..... 439/247, 248, 251
See application file for complete search history.

(56) References Cited

U.S. PATENT DOCUMENTS

| | | | | |
|---|---|---|---|---|
| 4,374,317 | A * | 2/1983 | Bradshaw | 219/385 |
| 6,242,993 | B1 * | 6/2001 | Fleege et al. | 335/18 |
| 6,347,950 | B1 * | 2/2002 | Yokoyama et al. | 439/248 |
| 7,281,958 | B2 * | 10/2007 | Schuttler et al. | 439/709 |

* cited by examiner

*Primary Examiner* — Hien Vu
(74) *Attorney, Agent, or Firm* — Fenwick & West LLP

(57) ABSTRACT

A floating bus bar connector connects a computing asset to bus bars using a connecting clip and a conducting terminal that is coupled to the connecting clip and to an electronic component inside the computing asset. To simplify connection to the bus bars, the floating bus bar connector is mounted to a chassis of the computing asset so that the entire connector is movable, relative to the chassis, in a direction perpendicular to the bus bar. Thus, if the floating bus bar connector and bus bars become misaligned when the computing asset is being connected to the bus bars, the floating bus bar connector may move to realign with the bus bars.

23 Claims, 5 Drawing Sheets

FLOATING BUS BAR CONNECTOR

BACKGROUND

This invention relates generally to rack-mounted computing equipment, and in particular to mechanisms for connecting a computing asset to electric power sources.

Many rack-mounted computing systems contain a pair of bus bars that distribute electrical power to the electronic devices mounted on the rack. A pair of bus bar clips are often rigidly mounted to the chassis of a device or rigidly mounted to a printed circuit board (PCB) that is itself rigidly mounted to the chassis of the device. When the device is inserted into the rack, the bus bar clips become engaged with the bus bar to provide power to the device. Because the bus bar clips are rigidly mounted, it is easy for the bus bar clips, the bus bars, the chassis, or the PCB to be damaged if the bus bar clips are misaligned when the device is inserted into the rack.

SUMMARY

To prevent damage from occurring when bus bars on a device are not properly aligned with bus bar clips, embodiments of the invention provide a floating bus bar connector capable of moving relative to the chassis of a computing asset. The floating bus bar connector includes a connecting clip for coupling to a bus bar and a conducting terminal that connects to an electronic component inside the computing asset. The connecting clip and conducting terminal are securely mounted to a carrier plate, which is mounted to the chassis in a manner that allows the floating-bus bar connector to move relative to the chassis in a direction perpendicular to the bus bar. Thus, if the bus bar connector becomes misaligned with the bus bars while the computing asset is inserted into the rack, the bus bar connector may move in the appropriate direction to realign with the bus bars.

In one embodiment, the end of the connecting clip has gatherings that curve outward to engage with the bus bars when the connector is misaligned. The floating bus bar connector may also include a second connecting clip and conducting terminal mounted to the carrier plate, which allows a single connector to couple the computing asset to two bus bars. In one embodiment, the connector is moveably mounted to the chassis of the computing asset with four standoffs that are inserted through four slots in the corners of the carrier plate.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 1:
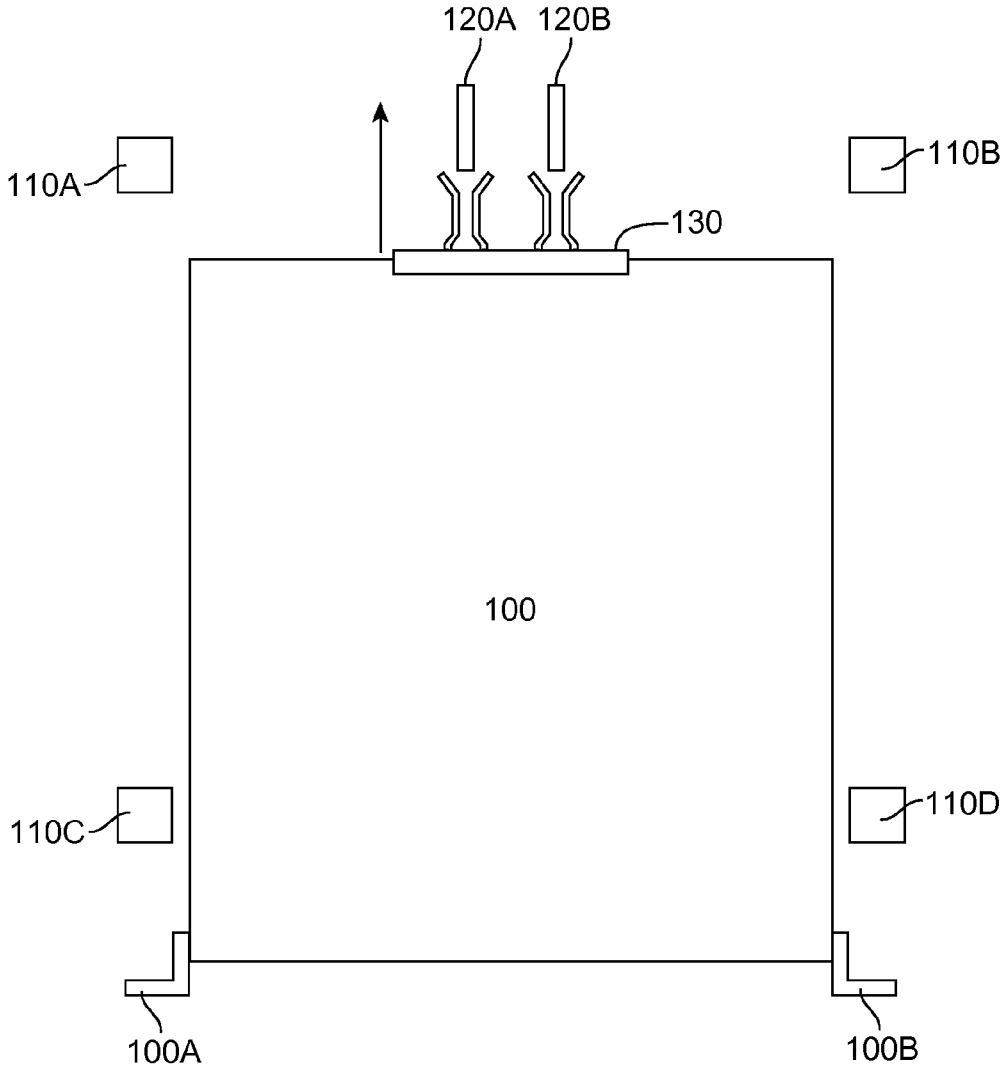
FIG. 1 is top-down view of a computing asset, a rack, a pair of bus bars, and a floating bus bar connector, in accordance with an embodiment of the invention.

A floating bus bar connector allows for misalignment between the connector and bus bars when installing a computing asset in a rack. FIG. 1 shows an example of a computing asset 100, a rack 110, bus bars 120, and the floating bus bar connector 130. The computing asset 100 may be any electronic device that draws power from an external source. A typical computing asset 100 includes a plurality of electronic components (e.g., a motherboard) mounted inside a chassis. In some embodiments, the computing asset 100 is a server that is dedicated to running services to serve the needs of computing devices that are connected over a network.

The computing asset 100 may be mounted in a rack 110. For purposes of illustration, FIG. 1 depicts the rack 110 using four posts 110A, 110B, 110C, 110D representing the corners of the rack. However, a rack with only two posts may also be used. In some embodiments, the computing asset 100 may be secured directly to the rack 110 with mounting brackets 100A and 100B. Alternatively, the computing asset 100 may be mounted on a sliding rail system that is secured to the rack 110, or the computing asset 100 may be secured to the rack 110 with some other method. The rear of the rack 110 includes a pair of floating bus bars 120A and 120B for providing a positive and negative supply voltage to the computing asset 100. The floating bus bars 120A, 120B are typically made of a conductive material (e.g., copper) and carry electrical power between a power supply and one or more computing assets 100 mounted on the rack 110.

The rear of the computing asset 100 includes a floating bus bar connector 130 that couples to the bus bars 120A, 120B when the computing asset 100 is installed in the rack 110. To install the computing asset computing asset 100 into the rack 110, the computing asset 100 is inserted into an opening in the rack 110 and pushed toward the rear of the rack 110, away from the opening, to couple the floating bus bar connector 130 with the bus bars 120A, 120B.

In the embodiment illustrated in FIG. 1, the bus bars 120A, 120B are oriented vertically and the floating bus bar connector 130 is mounted in a way that allows it to move horizontally relative to the chassis of the computing asset 100. Thus, if the user misaligns the chassis with the bus bars 120A, 120B when installing the computing asset 100 (e.g., if the chassis is slightly too far to the left or right), then the floating bus bar connector 130 may move relative to the chassis to properly align with the bus bars 120A, 120B for coupling. In an embodiment where the bus bars 120 are oriented horizontally, the floating bus bar connector 130 is mounted in a manner that allows it to move vertically relative to the chassis of the computing asset 100.

Although the embodiment of FIG. 1 includes a single connector 130 that couples to both floating bus bars 120A, 120B, an alternative embodiment may include two separate floating bus bar connectors that each couple to a single bus bar 120. This allows the separate floating bus bar connectors to move independently relative to each other and also allows the two bus bars 120A, 120B to be spaced farther apart. In another alternative embodiment, the rack 100 is oriented horizontally. Thus, the bus bars 120A, 120B are oriented horizontally, rather than vertically, and the floating bus bar connector 130 moves vertically relative to the chassis. Still another alternative embodiment may include a single floating bus bar 130 connector that couples to a single bus bar 120. In this embodiment, the other supply voltage may be provided to the computing asset 100 by a flexible power cable, a rigid bus bar clip, or some other connection device.

Figure 2:
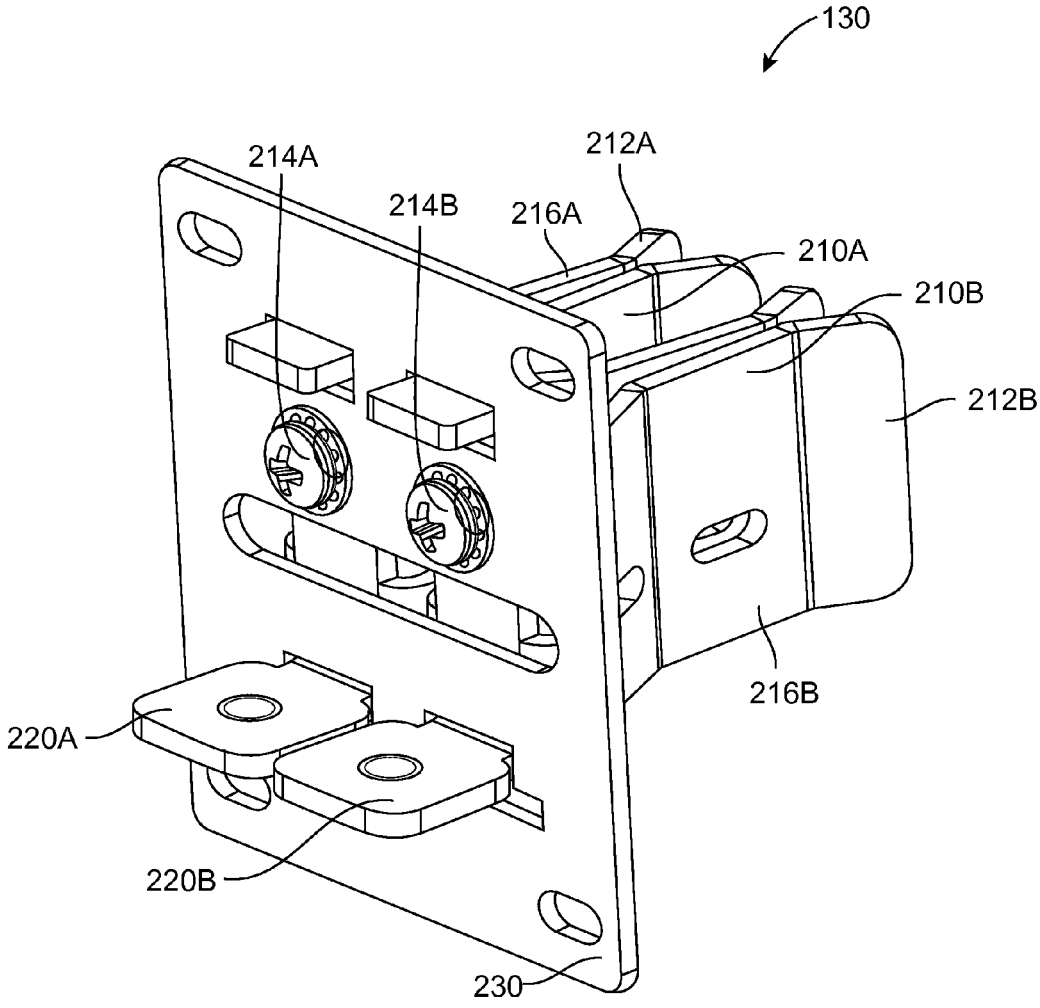
FIG. 2 is a perspective view of a floating bus bar connector comprising a carrier plate, two connecting clips, and two conducting terminals, in accordance with an embodiment of the invention.

FIG. 2 illustrates an embodiment of the floating bus bar connector 130. The floating bus bar connector 130 includes two connector clips 210A, 210B and two conducting terminals 220A, 220B that are securely mounted to a non-conductive carrier plate 230. In one embodiment, the carrier plate 230 is made of a conductive material and covered with a non-conductive material, such as a powder coat. Alternatively, the carrier plate 230 may be made of a non-conductive material, such as plastic.

Each connector clip 210A, 210B mechanically couples to a bus bar 120A, 120B to transmit power. The ends of the connector clips 210A, 210B may have gatherings 212A, 212B that curve outward to engage with the bus bars 120A, 120B when the computing asset is pushed into the rack. As the connector clips 210A, 210B are mounted to the carrier plate 230 with fasteners 214A, 214B (e.g., screws, etc.), the gatherings 212A, 212B cause the entire floating bus bar connector 130 to move horizontally to align with the bus bars 120A, 120B when being coupled to the bus bars 120A, 120B. After the bus bars 120A, 120B are engaged, they become clamped at the inner portion 216A, 216B of the connector clips 210A, 210B, and the interior surfaces of the connector clips 210A, 210B contact with and press against the bus bars 120A, 120B to establish an electrical connection. To prevent electrical conduction with stray objects, the non-contacting surfaces of the connector clips 210A, 210B may optionally be covered with a powder coat or some other non-conducting material.

Each conducting terminal 220A, 220B is coupled to one of the connector clips 210A, 210B and is configured to be coupled to an electronic component in the computing asset 100. In the illustrated embodiment, the conducting terminals 220A, 220B are lugs with large landing pads, and power cables are attached to the lugs with fasteners. In an alternative embodiment, the large landing pads of the conducting terminals 220A, 220B are omitted and cable lugs are screwed into openings in a conductive material. In the illustrated embodiment, each conducting terminal 220A, 220B and corresponding connector clip 210A, 210B is integrated into a single physical component that is secured to the carrier plate 230 with a single fastener 214A, 214B. However, the conducting terminals 220A, 220B and connector clips 210A, 210B may also be discrete components that are separately mounted to the carrier plate 230 and conductively coupled to each other.

The floating bus bar connector 130 may also include optional wire spring clips attached to each connector clip 210A, 210B. The wire spring clips engage with slots in the connector clips 210A, 210B and press inward to increase the clamping force against the bus bars 120A, 120B. This results in a more secure and reliable electrical connection between each connector clip 210A, 210B and the corresponding bus bar 120A, 120B.

Figure 3A:
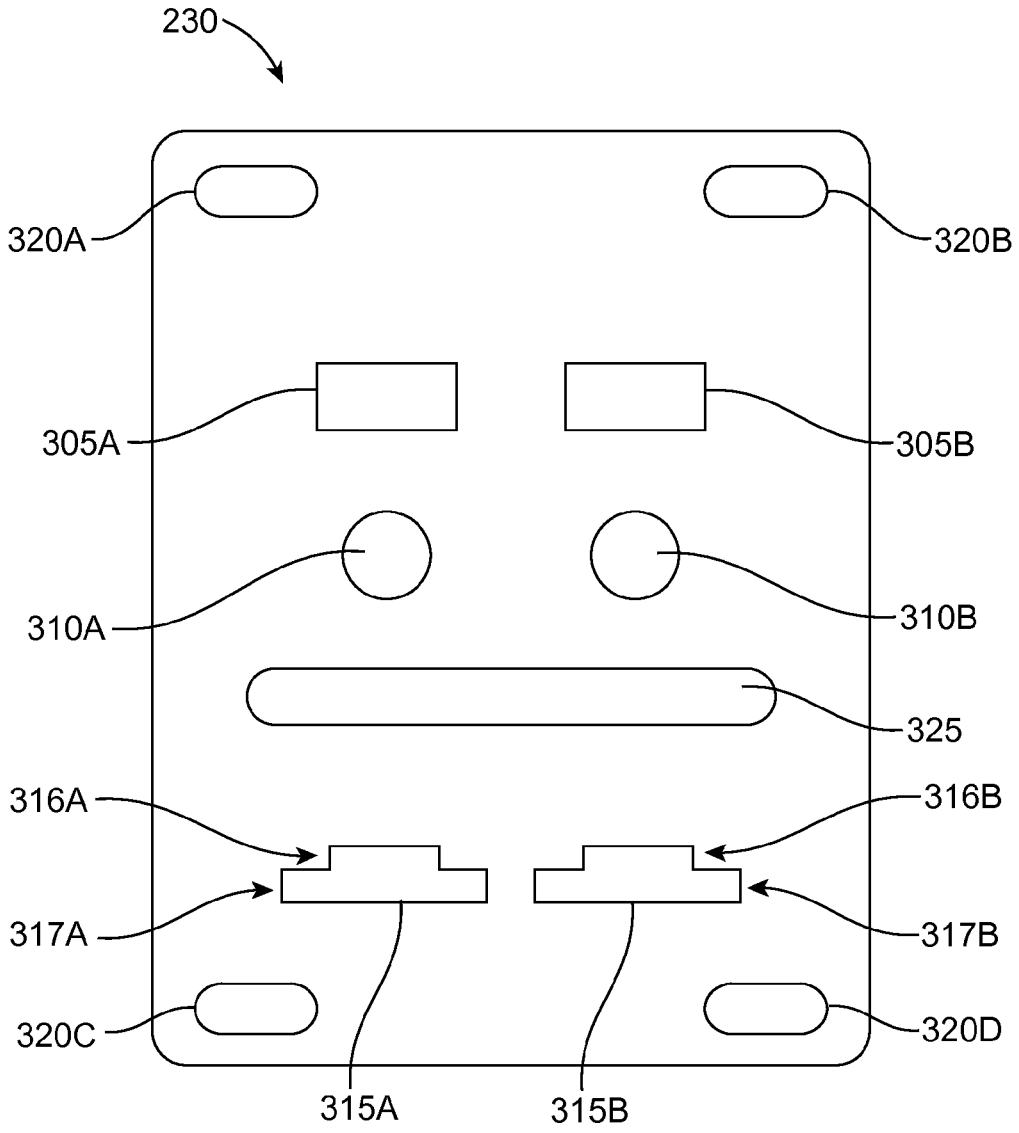
FIG. 3A is a front view of a carrier plate of a floating bus bar connector, in accordance with an embodiment of the invention.

FIG. 3A shows a front view of a carrier plate 230 of a floating bus bar connector 130. The carrier plate 230 includes a variety of openings that interact with different parts of the floating bus bar connector 130. The rectangular upper tab slots 305A, 305B receive upper tabs that are part of the connector clips 210A, 210B to align the connector clips 210A, 210B in a horizontal direction. In some embodiments, the width of the upper tab slots 305A, 305B have a reduced manufacturing tolerance so that the distance between the two connector clips 210A, 210B matches the distance between the two bus bars 120A, 120B with a high degree of accuracy. Additionally, the height of the upper tab slots 305A, 305B may be greater than the thickness of the upper tabs, which provides vertical clearance and allows the fasteners 214A, 214B that couple the connector clips 210A, 210B to the circular holes 310A, 310B to define the vertical position of the connector clips 210A, 210B relative to the carrier plate 230. Similarly, the lower tab slots 315A, 315B may have a greater height than the thickness of the lower tabs of the connector clips 210A, 210B and may include a narrow portion 316A, 316B with a reduced width tolerance. If the lower tabs include lugs and large landing pads, such as in the embodiment shown in FIG. 2, then the lower tab slots 315A, 315B may also have a wider portion 317A, 317B that allow the landing pads to be inserted through the carrier plate 230 when securing the connector clips 210A, 210B to the carrier plate 230. A process for securing the connector clips 210A, 210B to the carrier plate 230 is described in detail with reference to FIG. 3B.

In addition to the upper tab slots 305A, 305B, the circular holes 310A, 310B, and the lower tab slots 315A, 315B, the carrier plate 230 also includes horizontal slots 320A-320D at the corners of the carrier plate 230 and a central slot 325. The horizontal slots 320A-320D are used to mount the carrier plate 230 to the chassis of the computing asset 100 and allow the floating bus bar connector 130 to move horizontally relative to the chassis. An example method of mounting the carrier plate 230 to the chassis is described in detail with reference to FIG. 3C. Meanwhile, the central slot 325 provides clearance for the optional wire spring clips described with reference to FIG. 2. The central slot 325 may be omitted if wire spring clips are not used.

Figure 3B:
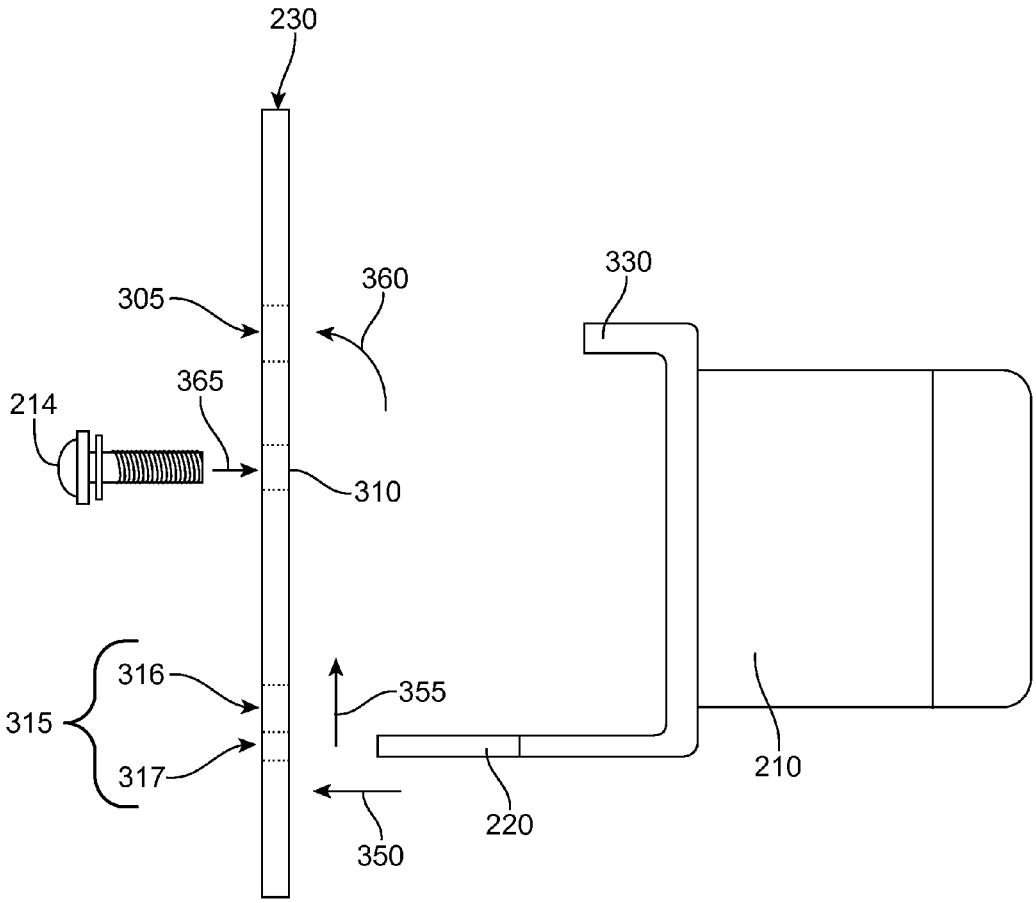
FIG. 3B is a side view of a carrier plate, a connector clip, and a conducting terminal, in accordance with an embodiment of the invention.

FIG. 3B is a side view of a connector clip 210 and conducting terminal 220 being secured to the carrier plate 230. As described above with reference to FIG. 3A, the connector clip 210 may include tabs 330, 220 that are inserted into the upper tab slots 305 and into the lower tab slots 315 to define the horizontal position of the connector clip 210. In the illustrated embodiment, the lower tab includes a lug that acts as the conducting terminal 220. To secure the connector clip 210 to the carrier plate 230, the lower tab 220 is inserted 350 through the wider portion 317 of the lower tab slot 315, and the entire connector clip 210 is pushed 355 in a direction perpendicular to the direction in which the lower tab 220 was inserted (upward in the embodiment of FIG. 3B) so that the lower tab 220 is held within the narrow portion 316 of the lower tab slot 315. The connector clip 210 is then rotated to insert 360 the upper tab 330 into the upper tab slot 305, and a fastener 214 is inserted into one of the circular holes 310 to securely couple 365 the connector clip 210 to the carrier plate 230. Because the carrier plate 230 is non-conductive, there is no electrical conduction between the connector clip 210 and the carrier plate 230 even though they physically contact each other.

Figure 3C:
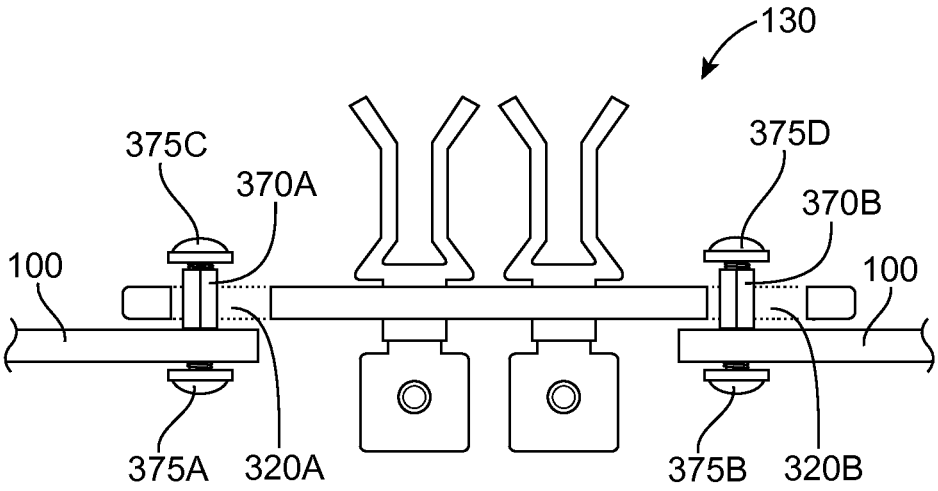
FIG. 3C is top-down cut-out view of a floating bus bar connector mounted to a chassis of a computing asset, in accordance with an embodiment of the invention.

FIG. 3C illustrates a floating bus bar connector 130 attached to the chassis of the computing system 100 using standoffs 370A, 370B. The standoffs 370A, 370B are inserted through the horizontal slots 320A, 320B and secured to the chassis by fasteners 375A, 375B, which are attached to a forward side of the standoffs 370A, 370B. Additional fasteners 375C, 375D are attached to a rear side of the standoffs 370A, 370B to prevent the carrier plate 230 from moving away from the chassis. The horizontal slots 320A, 320B allow the connector 130 to move freely in the horizontal direction, with the width of the horizontal slots 320A, 320B defining the range of motion of the floating bus bar connector 130. In other embodiments, the standoffs 370A, 370B may be fused to the chassis, eliminating the need for the fasteners 375A, 375B attached to the forward side of the standoffs 370A, 370B. Alternatively, another suitable type of protruding element may be inserted through the horizontal slots 320A, 320B to mount the connector 130 to the chassis. While FIG. 3C depicts two of the horizontal slots 320A-320D, similar mounting techniques are used for the other two horizontal slots 320C, 320D.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. An apparatus comprising:

a rack holding a plurality of rack-mounted computing assets therein;

a bus bar carrying power to a plurality of computing assets mounted in the rack, the bus bar extending along a side of the rack in a first direction;

a computing asset comprising a chassis configured to be mounted in the rack;

a carrier plate attached to the chassis of the computing asset and configured to move relative to the chassis in a second direction perpendicular to the first direction;

a connector clip mechanically coupling to the bus bar, the connector clip mounted to the carrier plate and moveable with the carrier plate in the second direction, the connector clip having at least one conducting surface configured to contact a surface of the bus bar to transmit electrical power therebetween; and a conducting terminal directly coupled to extending from a side of the connector clip, the conducting terminal coupled to an electronic component of the computing asset and the conducting terminal of the connector clip distal to the carrier plate curving away from a plane including the bus bar to form a gathering for engaging the connector clip with the bus bar.

2. The apparatus of claim 1, further comprising:

a second bus bar extending along the side of the rack in the first direction;

a second connector clip mechanically coupling to the second bus bar, the second connector clip mounted to the carrier plate and moveable with the carrier plate in the second direction, and the second connector clip having at least one conducting surface configured to contact with a surface of the second bus bar to transmit electrical power therebetween; and a second conducting terminal directly coupled to the second connector clip, the second conducting terminal coupled to the electronic component of the computing asset.

3. The apparatus of claim 1, further comprising a wire spring clip coupled to the connector clip and configured to press the at least one conducting surface of the connector clip against the surface of the bus bar.

4. The apparatus of claim 1, wherein the connector clip further comprises one or more non-contacting surfaces coated in a non-conductive material.

5. The apparatus of claim 1, wherein the first direction is a vertical direction and the second direction is a horizontal direction.

6. The apparatus of claim 1, wherein the connector clip further includes a protruding tab and wherein the carrier plate comprises a rectangular slot for receiving the tab, the rectangular slot defining a position of the connector clip relative to the carrier plate to within a tolerance value.

7. The apparatus of claim 1, wherein the carrier plate comprises a slot oriented in the second direction and configured to receive a protruding member mounted on the chassis to moveably attach the carrier plate to the chassis.

8. The apparatus of claim 1, wherein the carrier plate is covered in a non-conductive power coat.

9. The apparatus of claim 1, wherein the carrier plate is made of a non-conductive material.

10. An apparatus comprising:

a chassis housing one or more electronic components;

a carrier plate attached to the chassis and configured to move relative to the chassis in a second direction perpendicular to a first direction;

a connector clip mechanically coupling to a bus bar carrying power and extending along the first direction, the connector clip mounted to the carrier plate and moveable with the carrier plate in the second direction, the connector clip having at least one conducting surface configured to contact a surface of the bus bar to transmit electrical power therebetween; and a conducting terminal coupled to extending from a side of the connector clip, the conducting terminal configured to be coupled to an electronic component housed in the chassis transmitting electrical power to the electronic component and the conducting terminal of the connector clip distal to the carrier plate curves away from a plane including the bus bar to form a gathering for engaging the connector clip with the bus bar.

11. The apparatus of claim 10, further comprising:

a second connector clip mechanically coupling to a second bus bar extending along the first direction, the second connector clip mounted to the carrier plate and moveable with the carrier plate in the second direction, and the second connector clip having at least one conducting surface configured to contact with a surface of the second bus bar to transmit electrical power therebetween;

a second conducting terminal coupled to the second connector clip, the second conducting terminal configured to be coupled to the electronic component housed in the chassis to transmit electrical power to the electronic component.

12. The apparatus of claim 10, further comprising a wire spring clip coupled to the connector clip and configured to press the at least one conducting surface of the connector clip against the surface of the bus bar.

13. The apparatus of claim 10, wherein the connector clip further comprises one or more non-contacting surfaces coated in a non-conductive powder coat.

14. The apparatus of claim 10, wherein the carrier plate comprises a slot oriented in the second direction and wherein the slot receives a protruding member mounted on the chassis to moveably attach the carrier plate to the chassis.

15. The apparatus of claim 10, wherein the carrier plate is covered in a non-conductive powder coat.

16. The apparatus of claim 10, wherein the carrier plate is made of a non-conductive material.

17. An apparatus comprising:

a carrier plate attached to a chassis and configured to move relative to the chassis in a second direction perpendicular to a first direction;

a connector clip mechanically coupling to a bus bar carrying power and extending along a first direction, the connector clip mounted to the carrier plate and moveable with the carrier plate in the second direction, the connector clip having at least one conducting surface configured to contact with a surface of the bus bar to transmit electrical power therebetween; and a conducting terminal coupled to extending from a side of the connector clip, the conducting terminal configured to be coupled to an electronic component of a computing asset housed in the chassis for transmitting electrical power to the electronic component, and the conducting surface of the connector clip distal to the carrier plate curves away from a plane including the bus bar to form a gathering for engaging the connector clip with the bus bar.

18. The apparatus of claim 17, further comprising:

a second connector clip mechanically coupling to a second bus bar extending along the first direction, the second connector clip mounted to the carrier plate and moveable with the carrier plate in the second direction, and the second connector clip having at least one conducting surface configured to contact with a surface of the second bus bar to transmit electrical power therebetween;

a second conducting terminal coupled to the second connector clip, the second conducting terminal configured to be coupled to the electronic component housed in the chassis.

19. The apparatus of claim 17, further comprising a wire spring clip coupled to the connector clip and configured to press the at least one conducting surface of the connector clip against the surface of the bus bar.

20. The apparatus of claim 17, wherein the connector clip further comprises one or more non-contacting surfaces coated in a non-conductive powder coat.

21. The apparatus of claim 17, wherein the carrier plate comprises a slot oriented in the second direction, and wherein the slot receives a protruding member mounted on the chassis to attach the carrier plate to the chassis.

22. The apparatus of claim 17, wherein the carrier plate is covered in a non-conductive powder coat.

23. The apparatus of claim 17, wherein the carrier plate is made of a non-conductive material.

* * * * *